United States Patent [19]

Forestal et al.

[11] Patent Number: 4,575,149

[45] Date of Patent: Mar. 11, 1986

[54] ATTACHABLE HOUSEHOLD SERVICE TRAY DEVICE FOR FURNITURE

[76] Inventors: Robert J. Forestal, 2714 Coldstream Ln., Indianapolis, Ind. 46220; John R. Meek, P.O. Box 622, R.R. #1, Crawfordsville, Ind. 47933

[21] Appl. No.: 581,890

[22] Filed: Feb. 21, 1984

[51] Int. Cl.[4] ..... A47B 83/02; A47C 7/68

[52] U.S. Cl. ..... 297/194; 108/47; 108/135; 248/231.4; 248/240.4; 297/145; 297/153; 297/155; 297/162

[58] Field of Search ..... 297/145, 148–151, 297/153–155, 160, 162, 173, 194; 108/26, 28, 47, 134, 135; 248/231.4, 240, 240.4, 289.1

[56] References Cited

U.S. PATENT DOCUMENTS

| | | | |
|---|---|---|---|
| 2,647,716 | 8/1953 | Hudriak et al. | 108/47 X |
| 2,787,508 | 4/1957 | Math | 108/47 X |
| 2,867,401 | 1/1959 | Sheahan | 108/47 X |
| 2,896,895 | 7/1959 | Speese | 248/231.4 |
| 3,389,408 | 6/1968 | Pearson | 108/47 X |

FOREIGN PATENT DOCUMENTS

| | | | |
|---|---|---|---|
| 177232 | 1/1954 | Austria | 297/173 |
| 322650 | 12/1929 | United Kingdom | 108/47 |
| 470700 | 8/1937 | United Kingdom | 297/145 |
| 659121 | 10/1951 | United Kingdom | 297/173 |

*Primary Examiner*—William E. Lyddane
*Assistant Examiner*—Peter R. Brown
*Attorney, Agent, or Firm*—Robert A. Spray

[57] ABSTRACT

A household service tray device easily attached and removed from the arm of an article of furniture, by a clamping body securely held on and by the furniture arm. In one form, it provides a rotatable tray which, supported by the clamping body, swivels to provide an over-the-seat position and other positions, including one in which the tray automatically drops to a retracted and out-of-the-way position when not needed for use. In another form, an easily attachable table body provides an over-the-seat surface.

18 Claims, 5 Drawing Figures

ATTACHABLE HOUSEHOLD SERVICE TRAY DEVICE FOR FURNITURE

This invention relates to service trays, as for household use.

More particularly, the invention relates to household service trays such as used for holding snacks or for other uses of household tray devices such as so-called TV trays; but, although the tray devices of the present invention are as conveniently or more conveniently useful than are other tray devices such as TV trays, the present invention provides tray devices which are sturdily and easily attachable to household furniture in contrast to trays which are of free-standing but easily tipped variety.

Even more particularly, the inventive concepts relate to and provide household tray devices which are easily attachable and easily removable from the arm units of household furniture such as sofas or overstuffed chairs. Even side panels of articles only within a broad definition of furniture, such as a bathtub, may be used as the mounting unit, in uses such as to support a book, lotions, cosmetics, etc.; and the concepts of the invention provide that a single size device may be easily adjusted to fit a wide assortment of seat arms and even the most irregularly shaped arms of a variety of furniture articles.

Moreover, the invention provides a household service tray which is sturdily supported in the convenient location of being directly above the seated user's lap, in contrast to the somewhat awkwardly usable out-forward position of free-standing trays.

Further, the invention provides a household service tray device which provides rigid sturdiness of tray support in positions both directly over the user's lap and in an out-of-the-way position to the front and side of the furniture seat, thus easily and conveniently providing for the support of objects on the tray in both tray positions, and thus providing ease of access of the user to and from the furniture seat whose side-arm is provided with the device already attached to the side arm.

The household tray device of the invention also provides a convenient and sturdy support for easily-tippable objects such as beverage glasses, by a receiver means which not only gives support to such as object but which provides that the object is supported in a non-translatable manner even though, as indicated above, the tray is movable between positions in which there is a translatory movement of the tray.

Still further, the concepts achieve and provide a household tray device whose tray is easily and conveniently movable to a fully retracted and out-of-the-way position outwardly of the furniture seat, and which when in that position hangs vertically along the side of the furniture arm; and in such position the device is so relatively inconspicuous that it may be left attached to the furniture on a permanent basis, and may even be wholly concealed by no more than a piece of decorative cloth hardly larger than many arm-cover cloths.

The above description is of somewhat introductory and generalized form. More particular details, concepts, and features are set forth in the following and more detailed description of illustrative embodiments of two household tray devices of the invention, taken in conjunction with the accompanying drawings, which are of somewhat schematic and diagrammatic nature for showing of the inventive concepts, as well as illustrating the ease and convenience of assembly and dis-assembly of tray devices with respect to the furniture used to support the device. In the drawings.

Figure 1:
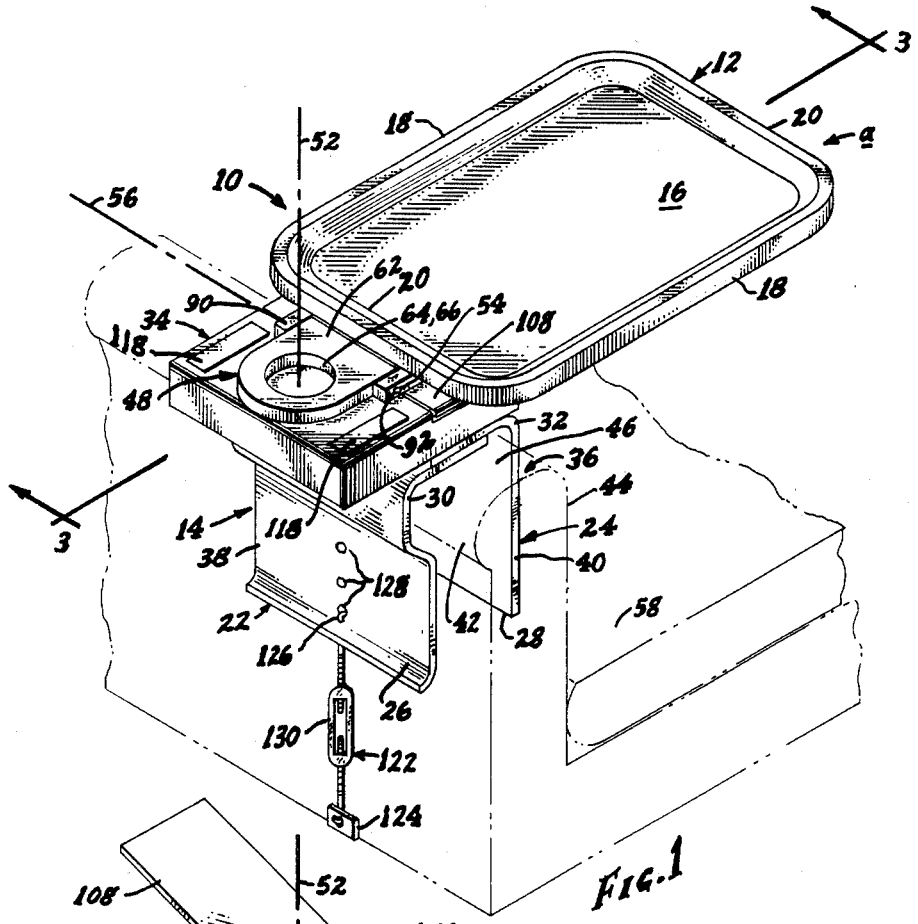
FIG. 1 is a pictorial view of a tray device of a first embodiment, shown as installed on an arm of a couch as a representative furniture article, and shown here in its position swung into its generally horizontal position over the couch seat adjacent the couch arm of the mounting.
Figure 2:
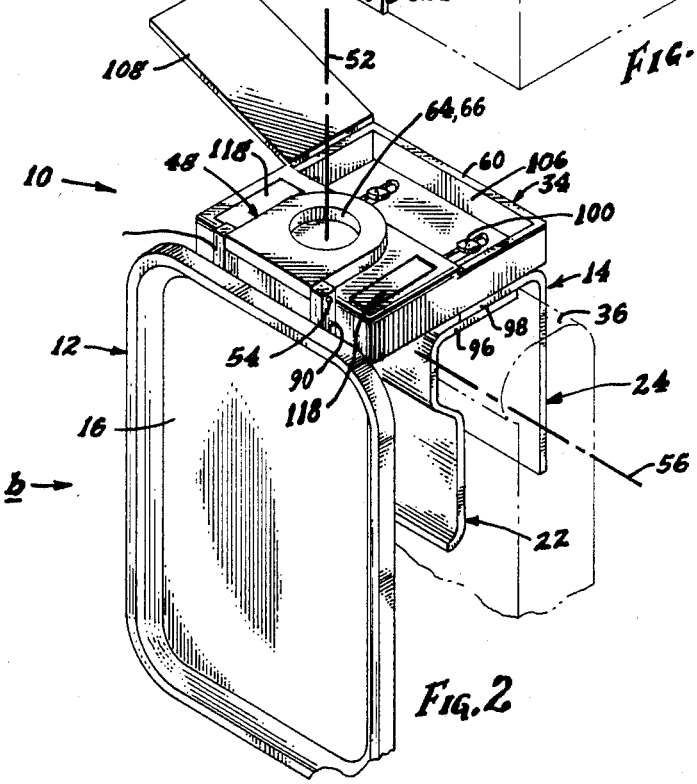
FIG. 2 is a pictorial view of the device of FIG. 1, but shown with the tray portion swung outwardly of the side of the couch, and with the tray hanging down in a retracted vertical position.

As shown in the drawings, the illustrative embodiments of the invention provide advantageous and useful trays for the user of whatever is the associated article of furniture, with features of ease of assembly and installation, movability of the tray for handy use but also with an out-of-the-way position during non-use, and other advantages.

The first embodiment illustrates such a furniture auxiliary device 10, as now detailed, having as its most conspicuous components a service tray 12 and what is referred to herein as a first support means 14. The tray means 12 itself may be and is shown here as quite conventional, having a flat bottom 16, side edges or rims 18, and end edges or rims 20. As such, it provides no part of the inventive concepts except as a component of the combination of concepts providing the overall device 10; and most of the concepts, and most of the description herein given, relate to the various tray-support components, of which the first support means 14 is only one.

The first support means 14 is shown as having a panel-like pair of leg means 22 and 24. The legs 22 and 24 are free at one end, that is their lower ends 26 and 28 respectively; but at the other or upper ends, respectively 30 and 32, they are shown as interconnected by a cross member means 34 shown as a rectangular or square block.

The connection of the legs 22 and 24 to the block or cross member 34 provides that the legs 22 and 24 are held generally parallel and in spaced relationship; and this provides that as an integral unit the first support means 14 of the device 10 may be placed onto an arm 36 or other side body of an associated article of furniture, with the free end-portions, 38 and 40 respectively, of the leg means 22 and 24 extending vertically and supportingly straddling the outer and inner sides 42 and 44 of the furniture arm 36, with the cross member 34 being generally horizontal.

The installation of the device is thus by a downward push of the legs 22 and 24 over the furniture arm 36, downwardly until the lower portion of the cross member 34 comes to rest on the upper surface 46 of the furniture arm 36. Further and more detailed features of the cross member 34 and of the legs 22 and 24 are specified below.

Herein, the outer leg means is referred to by numeral 22, and the inner leg means by numeral 24, the terms "outer" and "inner" being with reference to the arm 36 of the associated furniture article.

Continuing with a description of the tray 12, there is provided in the illustrative embodiment 10 an intermediate or second support means 48 shown as a block-like body member over and supported by the cross member 34, and there are provided what are referred to herein as first connection means 50 which rotatably interconnect the second support means 48 with the cross member 34; and since more than a single axis is significant in this device embodiment 10, the axis of this rotatable connection of the second supporting body 48 and the block 34 is identified as a first axis 52; and it will be noted that the first axis 52 is generally parallel with the two legs 22 and 24, and the axis 52 is generally vertical when the first support means 14 is installed onto the arm 36 of the associated article of furniture as has been indicated.

Further continuing the general description of support of the tray 12 for its positioning and maneuverability indicated, there are provided second connection means 54 which rotatably interconnect the service tray 12 and the second support means 48 about what is here referred to as a second axis 56; and the second axis 56 is to be noted as being generally perpendicular to but offset from the first axis 52 and is generally horizontal when the first support means 14 is installed onto the furniture arm 36.

It is to be particularly noted, as shown, that the location of the first axis 52 with respect to the cross member 34, and the location of the second axis 56 with respect to the service tray 12, and the location of both the first axis 52 and the second axis 56 with respect to the second support block 48, are such as to provide specific characteristics of positioning and maneuverability of the tray 12.

More particularly, these factors and concepts are such as to provide that the service tray 12 may optionally be positioned with respect to the first support means 14 (when installed onto the furniture arm 36) to provide to operative characteristics of optional choice. These choices are as follows:

(a) When the service tray 12 and the second support block 48 are rotated so that the service tray 12 is positioned over the furniture seat 58 which is adjacent the furniture article's arm 36, the service tray 12 is generally horizontal, and is supported by supporting engagement of the service tray 12 with the portion 60 of the cross member block 34 which is relatively inwardly of the furniture arm 36, providing what may be referred to as a service-operational position for an occupant of the said furniture seat 58; and (b) When the service tray 12 and the second support block or body 48 are rotated so that the service tray 12 is positioned outwardly of the chair arm 36, that is 180° from that service-operational position over the furniture seat 58, the service tray 12 is out of supporting engagement with the said cross member 34, and being then unsupported except at the pivotal pin 54 at the second axis 56 the service tray 12 hangs generally vertical in a retracted and generally out-of-the-way position.

The "hanging down" tray 12 position in condition "b" is such that the device 10, in that condition, may be left substantially permanently on the furniture arm 36 without appearing unsightly; and when so kept installed, it is very handy, being ready for instant and convenient use.

In the embodiment of the device 12, it is further to be noted that the first axis 52 and second axis 56 with respect to each other and to the cross member 34 and service tray 12 is such as to also provide that:

(c) the service tray means may be positioned in an intermediate position of the service tray means, in which it is extending forwardly and generally along the direction of extent of the furniture article's arm 36, and in this intermediate position the service tray 12 is still supported by its engagement with the cross member 34, thus providing both a supported generally horizontal orientation of the service tray 12 as described in position "a" although with the tray supported by a forward portion of the block 34, but providing that the service tray means is not over the furniture seat 58; and this position of the tray 12 thus provides both relatively free access of a person to or from the furniture seat 58 but nevertheless is fully supportive of objects resting on the support tray 12.

Handiness and convenient utility is further achieved as shown by the second support member 48 being provided on its upper surface 62 with an upwardly opening receiver means 64 which is as shown is generally concentric with the first connection axis 52; and this provides that if an object such as a beverage glass or cup is placed in the retainer means 64 the second support body 48 and the service tray 12 may be rotated (such as in movement of the tray 12 to be swung away so the person may be seated or rise from the seat) but the object positioned in the receiver means 64 will not be translated (even though revolved about its own axis), and thereby any tendency of the object to fall or tip will be only minimal even though the service tray 12 is rotated with respect to the article of furniture.

Desirably as shown the receiver means 64 is provided by providing an upwardly open recess 66 in the upper face 62 of the second support body 48, in a location as mentioned, i.e., generally concentric with the first connection axis 52.

Some extra rigidity is shown attained by providing that the means 50 which rotatably interconnects the second support block 48 to the cross member 34 is provided by the cross member body 34 being provided with a circular recess 70 opening upwardly, and the second support body 48 is provided with a downwardly extending circular boss means 72, these being of a free-fit relative size, and these being in addition to a bolt means 74 which extends vertically along the common axis of the circular recess opening 70 and the circular boss means 72.

Desirably as shown a head end 76 of the bolt means 74 is recessed into the second support member 48; and this provides the retention of the second support member 48 by the bolt means 74 but avoids an upstanding protrusion above the surface of the second support member, or into the bottom of the service recess 66 of the retainer means 64 already mentioned as desirably provided, at that location, in the second support body 48.

Similarly providing a recessed nature of that bolt connection 50, the lower face 80 of the support block 34 is shown as recessed, at the location of the axis 52 of that connection 50, by recess 82. This accommodates the presence of the nut 84 (and washer or washers as desired) of the bolt 74.

In the form of the device 10 shown, the service tray means 12 includes supportive arm means 90 extending from an end of the service tray 12, those supporting arm means or arms 90 being provided with aligned openings 92 receiving the pivot pin of the connection means 54 provided for the pivotal connection about axis 56 of the second support member 48 and the tray 12. It is the arm means 90 of the tray means 12 which thus supports the service tray 12 when in its "a" (or over the seat 58) position by not only providing part of the second connection means 54 but by supportingly resting upon the cross member body 34 of the first support means 14.

Assembly of the device 10 onto the furniture arm 36 is quite easy. It will be noted that the extremely lower end portion 26 of the outer leg 22 is flared outwardly, providing ease of assembly of the pair of legs 22–24 onto the associated furniture article's arm or side body 36. The inner leg 24, however is shown as not flared, its straightness accommodating ease of pushing the leg 24 between the inner side face 44 of the furniture arm 36 and an adjacent seat cushion of the furniture seat 58.

A single size device 10 easily fits most all sizes of furniture arms or side panel bodies 36. This accommodation is shown as provided by the first support means 14 being provided to have an adjustable connection of the pair of leg means 22–24 and the cross member means 34 thereof, this providing adjustability of the spacing between the two legs 22–24 for accommodation of various widths of the furniture arm or side bodies 36. Even though the adjustment of the two legs 22–24 is quite tight, as is desired for rigidity of support for the tray 12, the above-mentioned flaring of the lower portion 26 of the outer leg 22, and some resilience of the panels of the legs 22–24, provides for easy assembly onto the furniture arm 36.

Providing the desired width-adjustment, the leg means 22–24 of the first support means 14 are shown as provided as separate components. Each of them is generally of inverted-L shape (as viewed from the front of the furniture article when the device 10 is installed thereon), and the top (horizontal) portions 96 and 98 respectively of the leg means and the cross member 34 are provided with a connection bolt means 100 which fixedly fixedly interconnects the two leg means 22–24 and the cross member 34, with the top portions 96–98 of the leg means 22–24 juxtaposed and lying under the cross member block 34, the bolts 100 passing through openings 101 in the cross member 34.

At least one of the top or horizontal portions 96–98 of the leg means 22–24, here the top portion 96 of the outer leg 22, is provided with an extended opening means shown here as a pair of slots 101*a*, accommodative of optional spacing of the leg means 22–24 by the same connection bolt means 100. A pair of openings 104 in the top portion 98 of leg means 24 also accept the bolt means 100.

Figure 3:
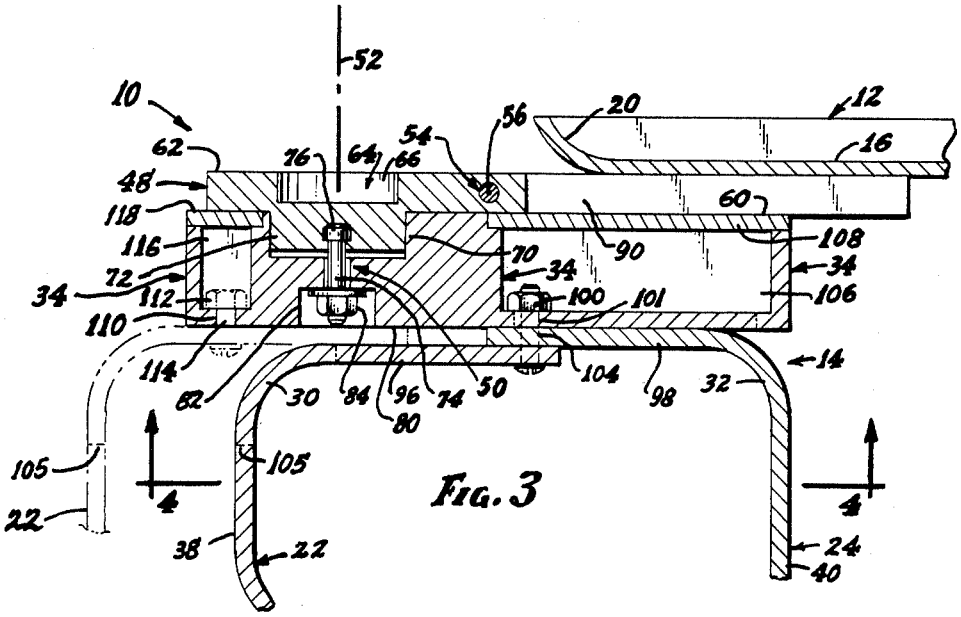
FIG. 3 is a vertical cross-sectional view, in enlarged scale, of the tray device of FIGS. 1 and 2, shown generally as taken by Section-line 3—3 of FIG. 1, the support means being shown in solid lines in a relatively close setting of the legs, and in chain lines a somewhat wider setting.
Figure 4:
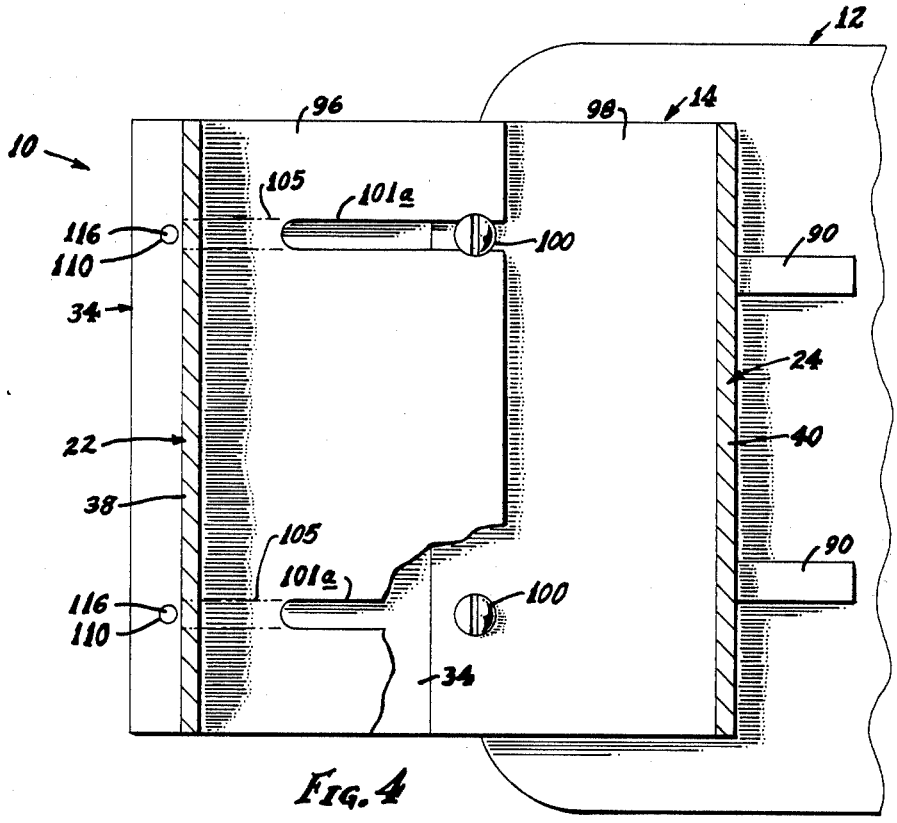
FIG. 4 is a horizontal cross-sectional view thereof, generally as taken by Section-line 4—4 of FIG. 3.
Figure 5:
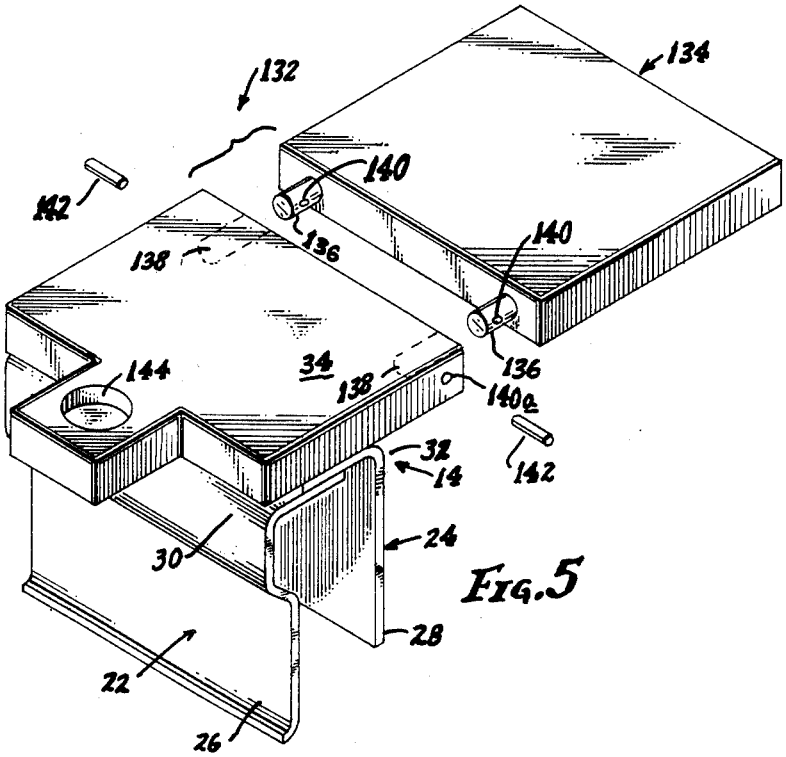
FIG. 5 is a pictorial view of a tray or table device of a second embodiment, drawn on a scale similar to that of FIGS. 1 and 2.

Desirably, the slots 101*a* are each provided to extend (105) past the end of the top portion 96 of the leg means 22 and into the vertical portion 38 of that leg means 22, thereby accommodating maximal adjustment of the two leg means 22–24 with respect to the spacing therebetween, as by optional extension to 105 (FIGS. 3, 4).

The top surface of the cross member body block 34 is shown as provided with an upwardly-opening recess 106 and a lid means 108 covering said recess, the recess 106 being in the location of the connection bolt means 100 which interconnects the leg means 22–24 and the cross member block 34; and this recess 106 advantageously provides both a covered utility compartment for the device 10 and a concealing of the upper end of that bolt means 100.

Maximizing the accommodation of various widths of the arms or side bodies 36 of the furniture to be equipped with the tray device 10, the top portions 96 and 98 respectively of the leg means 22–24, and the cross member means 34, are provided with other connection means. That is, the block-openings 101 are accompaned also with openings 110 closer to the outer edge of the block 34, thus providing that the connection of outer leg means 22 to the cross member block 34 is more variable and thus accommodative of the leg means 22–24 being held optionally either in a relatively narrow spacing of the leg means 22–24 in which their top portions 96–98 are juxtaposed, using block holes 101 for the connection bolt means 100, or in a relatively wide spacing of the leg means 22–24 in which their top portions 96–98 are spaced from one another, using the block holes 101 for portion 98 of the inner leg 24 but using block holes 110 for the portion 96 of the outer leg panel 22. The nuts 112 for the bolts 114 for such connection at holes 110 are concealed in a second compartment 116 opening to the top face of block 34, it being covered by a second lid 118.

Further accommodation of the style of some furniture arms 36 is provided. That is, the outer of the leg panels 22 is formed to provide that its upper portion 30 of its vertical portion 38 is spaced outwardly of the lower portion 26 of its vertical portion 38. This accommodates some larger width of the upper portion of the associated furniture article's arm or side body 36 than the lower portion of the furniture arm, yet it provides that the lower portion 26 of that vertical leg portion 38 is closely adjacent the lower portion of the furniture article's arm or side body, providing a neatly dressed appearance.

Extra rigidity is desirably provided by a retainer means 122 extending downwardly from the outer leg 22, the retainer means being shown with a hook or clamp 124 adapted to engage the underside of the associated article of furniture to provide additional tightness of the assembly of the device 10 onto the arm or side body 36 of the said furniture article. The retainer means 122 is desirably flexible, providing only tensile support, and desirably adjustable for tightness. It is shown with an upper hook 126 adapted to engage in any selected one of vertically-spaced holes 128 provided in the lower portion 26 of the outer leg panel 22. Adjustment is shown by turnbuckle 130.

The second embodiment 132 of the device is somewhat less complex in construction and of more limited operativity than the embodiment 10, yet it is nevertheless also an advantageous and useful furniture auxillary device.

As with the device 10 of the first embodiment, the device 132 of the second embodiment has a support means 14 like the first support means 14 of the first embodiment 10. That is, it has a pair of leg means 22–24 which are free at one end (their lower ends 26–28 respectively) but at the other or upper ends (respectively 30 and 32) they are interconnected by a cross member means 34 so that the leg means 22–24 are held generally parallel and in spaced relationship, providing that the support means 14 may be placed onto an arm or side body of an associated article of furniture with the free end-portion of the leg means 22–24 extending vertically and supportingly straddling the sides thereof, and the cross member means 34 is generally horizontal. Other features of the legs 22–24 and cross member block 34 may be like those of the device 10 of the first embodiment.

However, instead of the rotatability about vertical and horizontal axes 52 and 56 of the first embodiment 10, in this embodiment 132 there is provided a table means 134 and connection means for interconnecting the table means, to the cross member means 34, with the upper surfaces of the table means 134 and cross member means 34 co-planar and immediately adjacent one another. This provides in effect a continuous table surface by the table means and the cross member means.

In this embodiment 132, the connection means for the table 134 and cross member block 34 comprises a pair of pin means 136 spaced from one another, carried by the table means 134 and extending from a side edge portion of the table means 134; and the cross-member means 34 is provided with spaced openings 138 accommodative of the insertion thereinto of the pin means 136. That connection is made more fully secure by a cross-pin arrangement; that is, at least one of the pins 136 is provided with a transverse hole 140, and for the block hole 138 receiving that pin 136, the cross member block 34 is provided with a hole 140*a* transverse to but intersecting the hole 138, for receiving a retainer pin 142.

The cross block 34 desirably is provided with an unwardly-open receiver 144 like that of the receiver 64, for holding objects such as a beverage container.

This embodiment 132, even though in certain respects somewhat less desirable than the device 10 of the first embodiment, is nevertheless quite desirable as providing a handy writing surface or snack tray, etc., for an article of furniture; and its installation is easy, adjustable, rigid, and optionally permanent, as is the device 10 of the first embodiment.

It is thus seen that a household tray device, attachable to the side arm or panel of a variety of furniture articles, and constructed and used according to the inventive concepts herein set forth, provides a desired and advantageous device yielding the advantages of a conveniently usable household service tray useful for many uses, and easily attached and removed from the furniture article.

Accordingly, it will thus be seen from the foregoing description of the invention according to these illustrative embodiments, considered with the accompanying drawings, that the present invention provides new and useful concepts of a novel and advantageous household service tray device, having and yielding desired advantages and characteristics in construction and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

What is claimed is:

1. A furniture auxiliary device, comprising, in combination:

first support means having a pair of leg means free at one end but at the other end interconnected by a cross member means so that the leg means are held generally parallel and in spaced relationship, providing that the first support means of the device may be placed onto an arm or side body of an associated article of furniture with the free ends-portions of the leg means extending vertically and supportingly straddling the sides thereof, and the cross member means is generally horizontal and supported by the said furniture arm or side body;

a second support means;

first connection means rotatably interconnecting the second support means with the cross member means of the first support means about a first axis, said first axis being generally parallel with the two leg means, and generally vertical when the first support means is installed onto an arm or side body of the associated article of furniture as aforesaid;

a service tray means;

second connection means rotatably inteconnecting the service tray means and the second support means about a second axis, said second axis being generally perpendicular to but offset from the said first axis, and generally horizontal when the first support means is installed as foresaid;

the location of the first axis with respect to the cross member means, and the location of the second axis with respect to the service tray means, and the location of both the first axis and the second axis with respect to the second support member, being such as to provide that the service tray means may optionally be positioned with respect to the first support means to provide to operative characteristics of optional choice, including (a) when the service tray means and the second support means are rotated, so that the service tray means is positioned over the furniture seat inwardly adjacent the said furniture article's arm or side body, the service tray means is generally horizontal, and supported by supporting engagement of the service tray means with the portion of the cross member means which is relatively inwardly of the said arm or side body of the furniture article, providing a service-operational position for an occupant of the said furniture seat, and (b) when the service tray means and the second support means are rotated so that the service tray means is positioned outwardly of said arm or side body of the article of furniture, 180° from said service-operational position over the furniture seat inwardly adjacent the said article of furniture's arm or side body, the said service tray means is out of supporting engagement with the said cross member means, and being then unsupported except at the said second axis, the service tray means hangs generally vertical in a retracted and generally out-of-the-way position.

2. A furniture auxiliary device as set forth in claim 1, in a combination in which the location of the first axis and second axis with respect to each other and to the cross member means and service tray means is such as to also provide (c) that the service tray means may be positioned in an intermediate position of the service tray means, in which it is extending forwardly and generally along the direction of extent of the said associated furniture article's arm or side body, and in which position the service tray means is still supported by engagement thereof with the cross member means, providing both a supported generally horizontal orientation of the service tray means as in position "a" but providing that the service tray means is not over the said furniture seat, thus providing both relatively free access of a person to or from said furniture seat but nevertheless supportive of objects resting on the support tray means.

3. A furniture auxiliary device as set forth in claim 1, in a combination in which the said second support member is provided on its upper surface with an upwardly opening receiver means which is generally concentric with the said first connection axis, and providing that if an object is placed in the retainer means, the second support means and the service tray means may be rotated but the object positioned in the receiver means will not be translated even though revolved about its own axis, and thereby any tendency of the object to fall or tip will be only minimal even though the service tray means is rotated with respect to the said article of furniture.

4. A furniture auxiliary device as set forth in claim 3, in a combination in which the receiver means is provided by providing an upwardly open recess in the upper face of the second support means, in a location generally concentric with the said first connection axis as aforesaid.

5. A furniture auxiliary device as set forth in claim 1, in a combination in which the said first connection means, which rotatably interconnects the second support means to the cross member means, is provided by the cross member means being provided with a circular recess means opening upwardly, and the second support means is provided with a downwardly extending circular boss means, the recess and the boss means being of a free-fit relative size, and there is a bolt means which extends vertically along the common axis of the said circular recess opening and the said circular boss means.

6. A furniture auxiliary device as set forth in claim 5, in a combination in which a head end of the said bolt means is recessed into the said second support member, thus providing the retention of the said second support member by the bolt means but avoiding an upstanding protrusion above the surface of the second support member.

7. A furniture auxiliary device as set forth in claim 1 in a combination in which the said service tray means includes supportive arm means extending from an end of the service tray means, the said supporting arm means being provided with connection means cooperating with connection means provided for the said second support member for providing the said second connection means, and the said arm means thus support the service tray means when in its "a" position by providing part of said second connection means and by supportingly resting upon the said cross member means of the first support means.

8. A furniture auxiliary device as set forth in claim 1 in which the extremely lower end portion of the outer one of the leg means is flared outwardly, providing ease of assembly of the pair of leg means of the first support member onto the associated furniture article's arm or side body.

9. A furniture auxiliary device as set forth in claim 1 in which the first support means is provided to have an adjustable connection of the pair of leg means and the cross member means thereof, providing adjustability of the spacing between the two leg means for accommodation of various widths of the arm or side body of the associated article of furniture.

10. A furniture auxiliary device as set forth in claim 9 in which the extremely lower end portion of the outer of one of the leg means is flared outwardly, providing ease of assembly of the pair of leg means of the first support member onto the associated furniture article's arm or side body, even though the adjustment of the two leg means is so that the assembly thereof onto the said article's arm or side body is quite tight.

11. A furniture auxiliary device as set forth in claim 1 in a combination in which the leg means of the first support means are provided as separate components, each generally of inverted-L shape as viewed from the front of the furniture article when the device is installed thereon as aforesaid, the top portions of the leg means and the cross member means being provided with a connection bolt means which fixedly interconnects the two leg means and the cross member means, with the top portions of the leg means juxtaposed and lying under the cross member means.

12. A furniture auxiliary device as set forth in claim 11 in a combination in which at least one of the top portions of the leg means is provided with an extended opening means accommodative of optional spacing of the leg means by the same connection bolt means.

13. A furniture auxiliary device as set forth in claim 12, in a combination in which the extended opening means is provided as a slot means in the top portion of the respective leg means.

14. A furniture auxiliary device as set forth in claim 13 in a combination in which the slot means is provided to extend past the end of the top portion of the leg means and into the vertical portion of that leg means, accommodating maximal adjustment of the two leg means with respect to spacing therebetween.

15. A furniture auxiliary device as set forth in claim 11, in a combination in which the top surface of the cross member means is provided with an upwardly-opening recess and a lid means covering said recess, the said recess being provided in the location of the said connection bolt means for the leg means and the said cross member means, thereby providing both a covered utility compartment for the device and a concealing of the upper end of the last-designated connection bolt means.

16. A furniture auxiliary device as set forth in claim 1 in a combination in which the leg means of the first support means are provided as separate components, each generally of inverted-L shape as viewed from the front of the furniture article when the device is installed thereon as aforesaid, the top portions of the leg means and the cross member means being provided with connection bolt means accommodative of holding the leg means optionally either in a relatively narrow spacing of the leg means in which their top portions are juxtaposed, or in a relatively wide spacing of the leg means in which their top portions are spaced from one another.

17. A furniture auxiliary device as set forth in claim 1 in a combination in which the outer of the two leg means is formed to provide that its upper portion of its vertical portion is spaced outwardly of the lower portion of its vertical portion, thus accommodating some larger width of the upper portion of the associated furniture article's arm or side body than the lower portion thereof, yet providing that the lower portion of said vertical leg means portion is closely adjacent the lower portion of the said furniture article's arm or side body.

18. A furniture auxiliary device as set forth in claim 1 in a combination in which there is provided a retainer means extending downwardly from the outer one of the leg means, the retainer means being adapted to engage the underside of the associated article of furniture to provide additional tightness of the assembly of the device onto the arm or side body of the said furniture article .

* * * * *